US011798519B1

(12) United States Patent
Wright

(10) Patent No.: US 11,798,519 B1
(45) Date of Patent: Oct. 24, 2023

(54) ACOUSTIC GUITAR STRING MOUNTING SYSTEM AND METHOD

(71) Applicant: Denis E. Wright, Henderson, KY (US)

(72) Inventor: Denis E. Wright, Henderson, KY (US)

( * ) Notice: Subject to any disclaimer, the term of this patent is extended or adjusted under 35 U.S.C. 154(b) by 0 days.

(21) Appl. No.: 18/225,847

(22) Filed: Jul. 25, 2023

Related U.S. Application Data

(60) Provisional application No. 63/392,530, filed on Jul. 27, 2022.

(51) Int. Cl.
*G10D 3/12* (2020.01)
*G10D 3/04* (2020.01)
*G10D 1/08* (2006.01)

(52) U.S. Cl.
CPC ..... *G10D 3/12* (2013.01); *G10D 1/08* (2013.01); *G10D 3/04* (2013.01)

(58) Field of Classification Search
CPC ..... G10D 3/12; G10D 1/08; G10D 3/04
See application file for complete search history.

(56) References Cited

U.S. PATENT DOCUMENTS

| | | | | |
|---|---|---|---|---|
| 3,667,336 | A * | 6/1972 | Itzler | G10D 3/14 984/119 |
| 7,855,330 | B2 * | 12/2010 | Lyles | G10D 3/04 84/312 R |
| 9,792,886 | B2 * | 10/2017 | Lyles | G10D 3/12 |
| 10,224,009 | B2 * | 3/2019 | Lyles | G10D 3/12 |
| 11,250,822 | B2 * | 2/2022 | Kebrle | G10D 3/04 |
| 11,289,056 | B2 * | 3/2022 | Krobot | G10D 1/085 |
| 11,437,003 | B2 * | 9/2022 | Kebrle | G10D 3/04 |

* cited by examiner

*Primary Examiner* — Robert W Horn
(74) *Attorney, Agent, or Firm* — Taft Stettinius & Hollister LLP; Daniel J. Krieger

(57) ABSTRACT

A string mount system and method of installing guitar strings in an acoustic guitar. The string mount system includes a tonebar having a rod including a length extending from a first terminating end to a second terminating end. The tonebar includes a constant diameter extending along the length of the rod and the constant diameter is less than an inner diameter ball end of each string in a set guitar strings. The rod is located in a hole in each of the ball ends. The tonebar, with the mounted strings, is pulled against a bridge plate of the guitar. The strings are tuned to pitch. The strings are acoustically coupled to the bridge plate and to the sound board to vibrate the soundboard to produce acoustically amplified string tones.

20 Claims, 12 Drawing Sheets

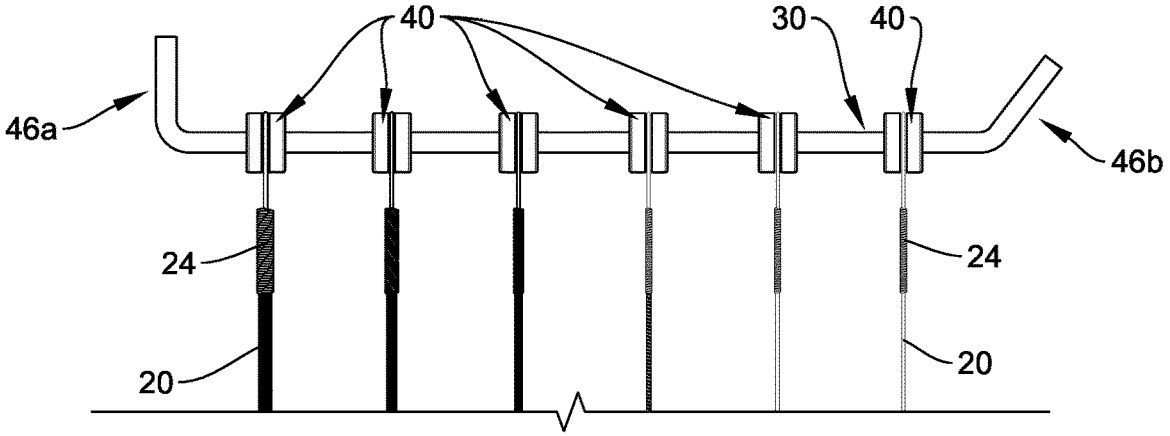
FIG. 10
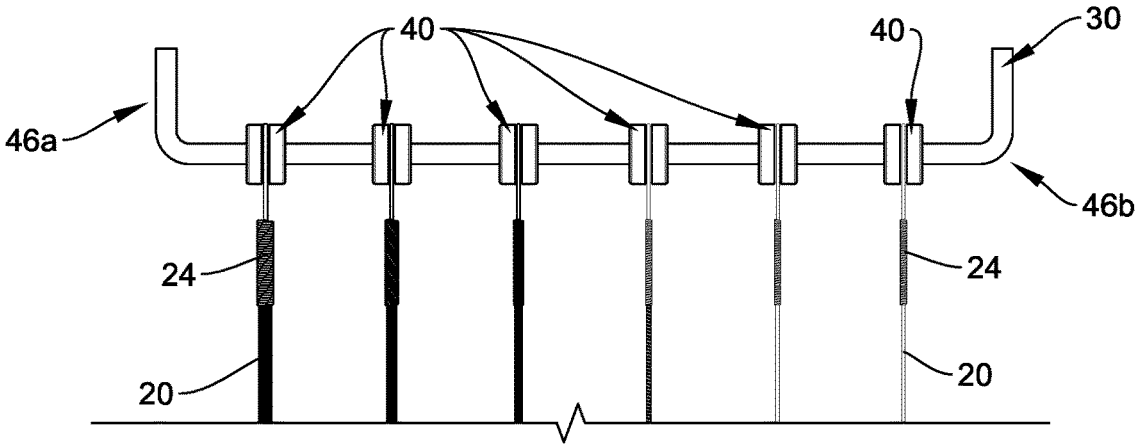
FIG. 11
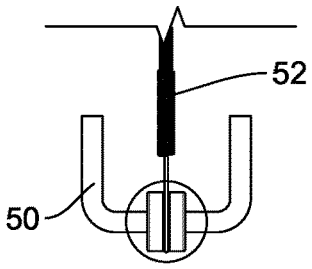
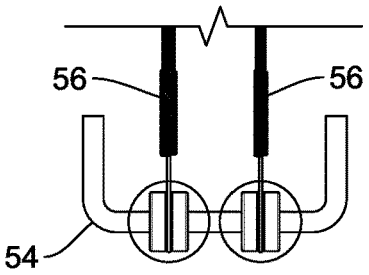
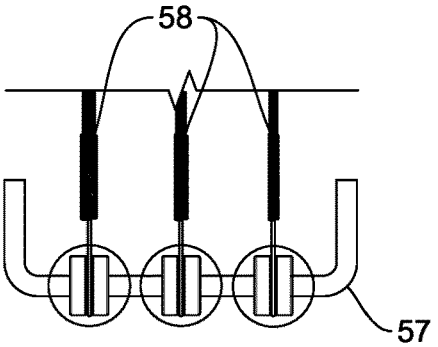
FIG. 12A FIG. 12B FIG. 12C Installation Instructions for Tonebar on Acoustic Guitars to eliminate Bridge Pins and add Better Tone.

ACOUSTIC GUITAR STRING MOUNTING SYSTEM AND METHOD

CROSS-REFERENCE TO RELATED APPLICATION

This application claims priority to U.S. Provisional Application No. 63/392,530, filed Jul. 27, 2022, entitled "Acoustic Guitar String Mounting System and Method" the disclosure of which is hereby incorporated by reference in its entirety.

FIELD OF THE DISCLOSURE

The present disclosure relates to a stringed musical instrument, and more particularly to a guitar string mounting system and mounting method.

A portion of the disclosure of this patent document contains material which is subject to (copyright or mask work) protection. The (copyright or mask work) owner has no objection to the facsimile reproduction by anyone of the patent document or the patent disclosure, as it appears in the Patent and Trademark Office patent file or records, but otherwise reserves all (copyright or mask work) rights whatsoever.

BACKGROUND

Many different types of string musical instruments include, but are not limited to, acoustic and electrically amplified instruments such as a guitar, bass, violin, cello, banjo, mandolin, and ukulele. A typical acoustic instrument includes a body made of wood or of a composite material, such as fiberglass. The body of many such instruments have a back made of wood and a soundboard made of wood, wherein the soundboard is made of the same wood or a different wood than the back. A neck extends from the body and, in some embodiments, terminates at a headstock where strings are attached. Tuning pegs are attached to the headstock and one end of the strings are held in place by the tuning pegs. The tuning pegs are adjustable to tune the strings to a desired or predetermined pitch.

The strings extend from the headstock and are attached to the soundboard through a bridge connected to a top of the soundboard. The bridge is fixed to the top and is glued in place at a predetermined location to establish a scale length for the strings to be properly tuned. A saddle is connected to the bridge and the strings extend across the saddle and into holes that are located in the bridge.

Because properly tuned strings apply a significant amount of string tension to the soundboard, a bridge plate is attached to a backside of the sound board, underneath the bridge, to provide structural rigidity to the soundboard. The soundboard and the bridge plate include holes that are aligned with the holes of the bridge. The ends of each of the strings include a ball end that is inserted through one of the aligned holes.

Before the guitar can be properly tuned, each ball end of each of the strings is held in place at each of the holes by a bridge pin. Since the ball end is located within the guitar body on the exposed side of the bridge plate, each of the holes is large enough to receive the ball end. The ball end is inserted completely through the bridge, the soundboard, and the bridge plate, and is held in place at the bridge plate by a bridge pin that is inserted through each of the holes.

The bridge pin includes a head portion and a leg portion. When the bridge pin is inserted in the hole from a top surface of the bridge, the leg extends completely through the aligned holes, and the head remains at the top surface of the bridge. The leg contacts the ball end of the string and holds the ball end against the bridge plate. To ensure that the ball end contacts the bridge plate, the ball end is displaced from a linear axis of the hole and towards the bridge plate. Consequently, a portion of the ball end is moved into contact with the bridge plate and held in place there by the bridge pin.

As the string is placed in motion to produce a tone, such as by plucking or strumming, the soundboard is vibrated. The vibrating soundboard and body amplify the sound of the vibrating string. The sound quality, including the tone as well as the volume, is based on the physical contact of the ball end with the bridge plate. Unfortunately this physical contact, and the sound produced, depends in part on the condition of the bridge plate, the condition of the bridge pins, and the limited amount of surface contact between the ball ends and the bridge plate. Consequently, the sound produced is not always ideal. In addition, the ball ends are known to damage the bridge plate over a period of time. What is needed therefore is a string mounting system and method of mounting the strings which improves the transmission of sound between the strings and the soundboard, enhances the sound quality, and increases the life of the guitar.

SUMMARY

In one embodiment, there is provided an acoustic guitar string mounting system for installing acoustic guitar strings having a ball end on a guitar having string holes extending through a bridge, a soundboard, and a bridge plate. The mounting system includes a tonebar including a rod, the rod including a length extending from a first terminating end to a second terminating end. The tonebar includes a constant diameter extending along the length of the rod and wherein the constant diameter is less than an inner diameter of each of the ball ends of the guitar strings. The rod is located in a hole in each of the ball ends of the strings.

In another embodiment, there is provided a method of installing a set of acoustic guitar strings having ball ends on an acoustic guitar having string holes extending through a bridge, a soundboard with a sound hole, and a bridge plate, the method comprising: providing a tonebar including a rod, the rod including a length extending from a first terminating end to a second terminating end, wherein the tonebar includes a constant diameter extending along the length of the rod and the constant diameter is less than an inner diameter of each of the ball ends of the guitar strings, inserting the ball end of one of the strings through one of the string holes, inserting the ball end of each of the remaining strings through one of the string holes not previously receiving an inserted ball end, pulling each string though the respective string hole and through the sound hole a sufficient distance such that each of the ball ends is accessible, inserting the first end of the rod into the ball end of a first one of the set of strings, inserting the first end of the rod into the ball end of each of the remaining strings, pulling each of the strings though the string holes from the top of the soundboard to engage the tonebar with the bridge plate, and tuning the guitar to a predetermined pitch.

In one implementation, there is provides an acoustic guitar string mounting system for installing acoustic guitar strings having ball end on a guitar having string holes extending through a bridge, a soundboard, and a bridge plate. The mounting system includes a tonebar including a rod, the rod including a length extending from a first terminating end to a second terminating end, wherein the tonebar includes a substantially constant diameter extending along the length of the rod and wherein the constant diameter is less than an inner diameter of a hole in each of the ball ends of the guitar strings, and the rod is located in the hole in each of the ball ends.

In some implementations, the acoustic guitar mounting system includes wherein the guitar is a six string guitar having six string holes with a first string hole spaced from a sixth string hole a predetermined distance apart, and the length of the rod is greater than predetermined distance.

In some implementations, the acoustic guitar mounting system includes wherein the inner diameter of the holes of each of the ball ends is substantially 0.082 inches In some implementations, the acoustic guitar mounting system includes wherein the constant diameter of the rod is substantially 0.078 inches.

In some implementations, the acoustic guitar mounting system includes wherein the constant diameter of the rod is substantially 0.005 inches less than the inner diameter of holes of the ball ends.

In some implementations, the acoustic guitar mounting system includes wherein one or both of the first terminating end and the second terminating end are bent with respect to a longitudinal axis of the rod.

In some implementations, the acoustic guitar mounting system includes wherein the first terminating end is bent to an angle of substantially 90 degrees with respect to a longitudinal axis of the rod.

In some implementations, the acoustic guitar mounting system includes wherein the second terminating end is bent to an angle of substantially 45 degrees.

In some implementations, the acoustic guitar mounting system includes wherein the rod is located in each of the ball ends of each of the six strings, and the strings are arranged sequentially from a first string to a sixth string along the rod.

In another implementation there is provided a method of installing a set of acoustic guitar strings on an acoustic guitar having string holes extending through a bridge, a soundboard with a sound hole, and a bridge plate, wherein each string of the set includes a ball end. The method includes: providing a tonebar including a rod, the rod including a length extending from a first terminating end to a second terminating end, wherein the tonebar includes a constant diameter extending along the length of the rod and the constant diameter is less than an inner diameter of each of the ball ends of the guitar strings; inserting the ball end of one of the strings through one of the string holes; inserting the ball end of each of the remaining strings through one of the string holes not previously receiving an inserted ball end; pulling each string though the respective string hole and through the sound hole a sufficient distance such that each of the ball ends is accessible; inserting the first end of the rod into the ball end of a first one of the set of strings; inserting the first end of the rod into the ball end of each of the remaining strings; pulling each of the strings though the string holes from the top of the soundboard to engage the tonebar with the bridge plate; and tuning the guitar to a predetermined pitch.

In some implementations, the method includes wherein each of the inserting and pulling steps are provided to a user with a set of instructions.

In some implementations, the method includes wherein the guitar is a six string guitar having six string holes with a first string hole spaced from a sixth string hole spaced a predetermined distance apart, and the length of the rod is greater than predetermined distance.

In some implementations, the method includes wherein the inner diameter of the ball ends is substantially 0.082 inches.

In some implementations, the method includes wherein the constant diameter of the rod is substantially 0.078 inches.

In some implementations, the method includes wherein the constant diameter of the rod is substantially 0.005 inches less than the inner diameter of the ball ends.

In some implementations, the method includes wherein one or both of the first terminating end and the second terminating end are bent with respect to a longitudinal axis of the rod.

In some implementations, the method further includes bending the first terminating end to an angle of substantially 90 degrees.

In some implementations, the method further bending the second terminating end to an angle of substantially 45 degrees.

In some implementations, the method includes wherein the rod is located in each of the ball ends of each of the six strings, and the strings are arranged sequentially from a first string to a sixth string along the rod.

In some implementations, the method includes wherein the set of acoustic guitar strings includes a set of standard tuning guitar strings having strings of low E, A, D, G, B, and E, and the inserting the first end of the rod into the ball end includes inserting the first end of the rod into one of the low E string or the high E string, and the inserting the first end of the rod into the ball end of each of the remaining strings includes inserting the first end of into ball ends of each string sequentially to connect each string to an appropriate tuning pegs of the guitar.

BRIEF DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings.

FIGS. 5-10 illustrate steps in a process to install strings one through six on a tonebar.

FIG. 11 illustrates a step in a process to finalize installation of strings as detailed in FIGS. 5-10.

FIGS. 12A, 12B, and 12C illustrate other embodiments of a tonebar of different lengths.

DETAILED DESCRIPTION

The embodiments of the present disclosure described below are not intended to be exhaustive or to limit the disclosure to the precise forms disclosed in the following detailed description. Rather, the embodiments are chosen and described so that others skilled in the art may appreciate and understand the principles and practices of the present disclosure.

Figure 1:
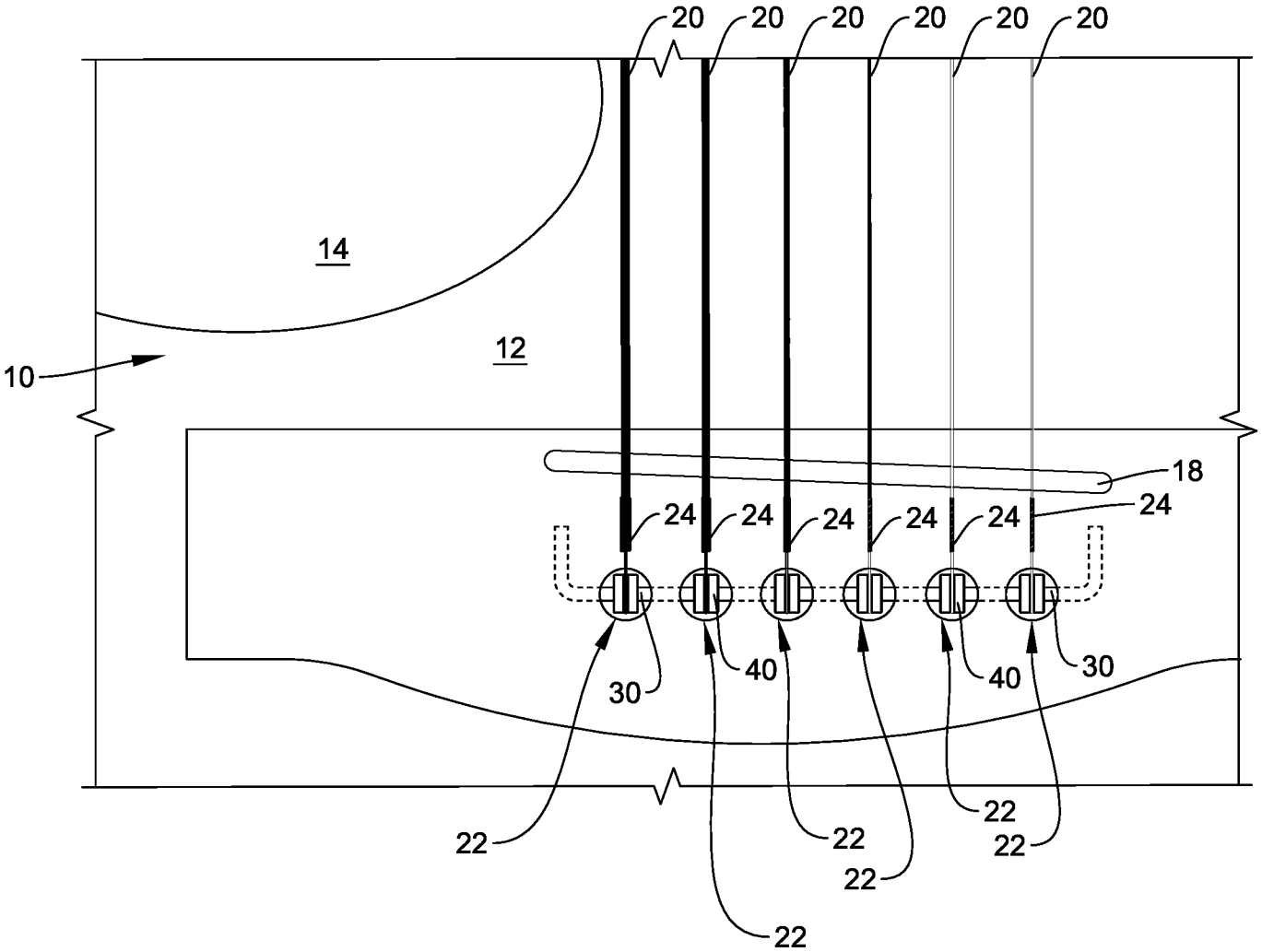
FIG. 1 illustrates a partial plan view of a topside of a guitar soundboard.

FIG. 1 illustrates a partial plan view of a topside 10 of a guitar soundboard 12. A pickguard 14 and a guitar bridge 16 are attached to the topside 10, as is understood by one skilled in the art. The bridge 16 supports a saddle 18 over which six individual strings 20 extend into string holes 22. Each of the strings 20 terminates with a ball end, not shown, and as later described, which are inserted into the holes 22. As described herein the holes 22 extend through the bridge 16, the guitar soundboard 12, and a bridge plate 32 (see FIGS. 2 and 3). The strings 20 include wound ends 24 that, in some embodiments, rest on the bridge 16. When the strings 20 are tuned and pulled into tension, the string contacts the saddle 18. In one embodiment, the strings 18 from left to right are identified as low E, A, D, G, A, and high E strings when the guitar is placed in standard tuning. Other types of strings and other tunings are contemplated. As seen in FIG. 1, each of the holes 20 is in an open condition and does not require bridge pins to hold the strings in place to either tune the guitar or to play the guitar. The guitar includes a sound hole 26.

Figure 2:
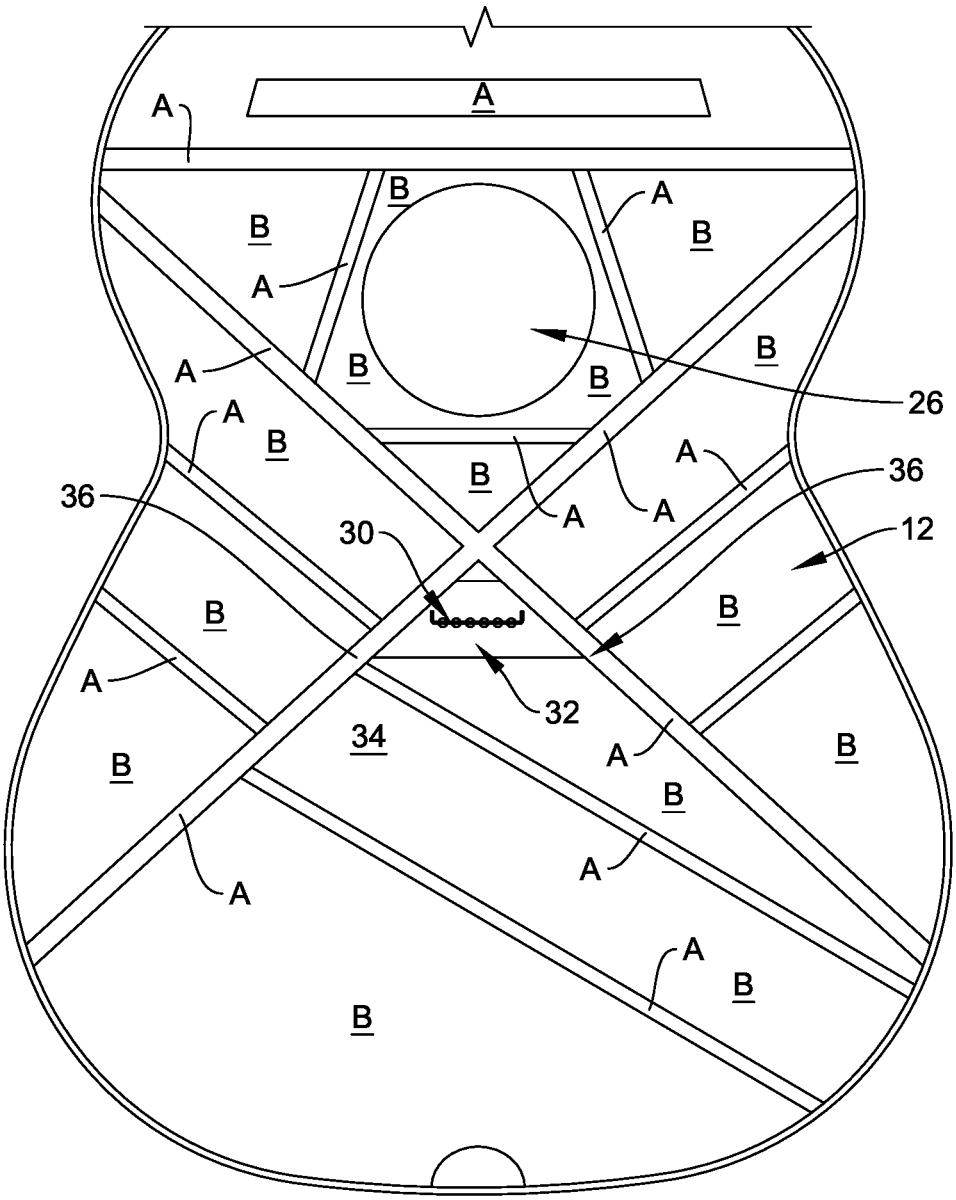
FIG. 2 illustrates plan view a tonebar acoustically coupled to and in contact with a bridge plate of a guitar.
Figure 3:
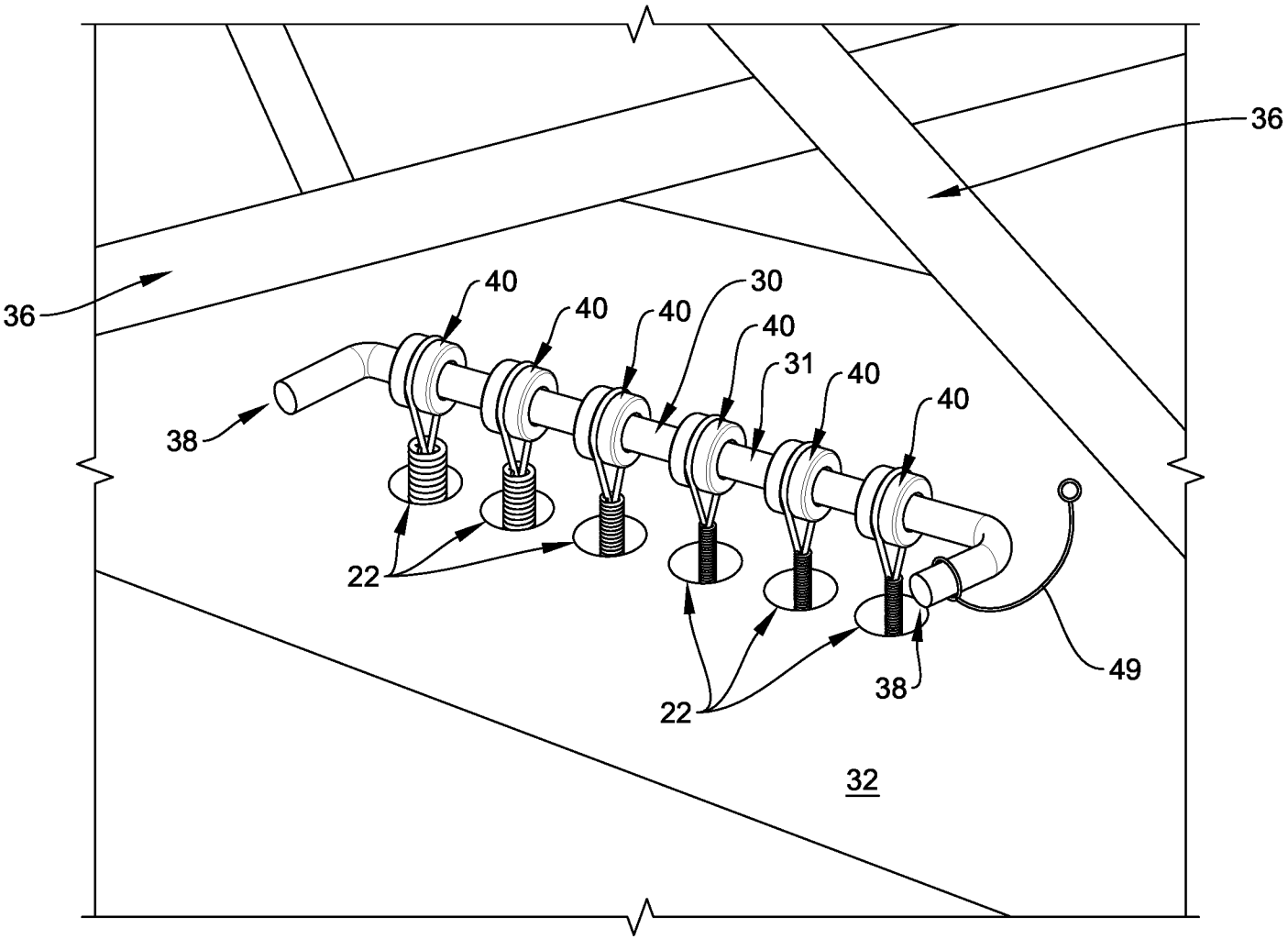
FIG. 3 illustrates a perspective view a plurality of strings coupled to a tonebar.

The requirement for bridge pins is eliminated due to the use of a tonebar 30 as illustrated in FIGS. 2 and 3. As seen in FIG. 2, the tonebar 30 is acoustically coupled to and in contact with a bridge plate 32. The bridge plate 32 is connected to a bottom side 34 of the guitar soundboard 12 located between top braces 36 as is understood by one skilled in the art. In FIG. 3, the tonebar 30 is shown spaced from the bridge plate 32 before the stings are brought to tension. Once the strings are tuned, the string tension pulls the tonebar 30 into contact with the bridge plate 32.

The tonebar 30 includes a bar 31 having a predetermined length with terminating ends 38. In one embodiment, a cross-section of the tonebar 30 includes a constant diameter along the length of the tonebar 30. In one embodiment, the tonebar 30 is a rod extending along its length from a first end to a second end. The constant diameter along the length of the tonebar improves sound transmission from the strings along the length of the tonebar to the bridge plate and to the soundboard. The rod is generally linear and defines a longitudinal axis extending along its length. In another embodiment, the cross-section is not constant along the length but varies from a first terminating end to a second terminating end.

Figure 4:
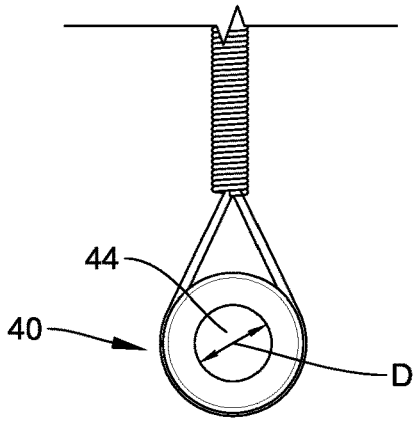
FIG. 4 illustrates a side view of a ball end of a guitar string.

The cross-section of the tonebar 30 is sized to receive ball ends 40 of each of the strings 20. In one embodiment and as illustrated in a side view of FIG. 4, ball end 40 is generally cylindrical and includes a hole 44 having a diameter, D, of substantially 0.082 inches. Other diameters are contemplated. The tonebar 30, in one embodiment, is consistently cylindrical along its length has a cross-section of substantially 0.078 inches. Consequently, a clearance of substantially 5 thousandths of an inch exists between the outer diameter of the tonebar 30 and the diameter of hole 44. In other embodiments, the tonebar 30 does not include a cylindrical cross-section, but includes other cross-sections such as rectangular, square, pyramidal, or hexagonal. Other cross-sections are contemplated.

The tonebar 30 includes, in one embodiment, a length of four (4) inches, which is substantially sufficient to extend through each ball end of each string and to provide the terminating ends 38 that extend past the hole 22 receiving the low E string and the past the hole receiving the high E string. As seen FIG. 5, each of the ends 38 include a bend or curve 46A and 46B. The bend 46A, in one embodiment, includes a bend of substantially 90 degrees and the bend 46B initially includes a bend of substantially 45 degrees, which is later modified to 90 degrees as described herein. The bend 46A provides a stop that prevents the ball ends from sliding off the end during string installation. The bend 46B initially includes an angle of less than 90 degrees and more particularly less than approximately 50 degrees that allows the ball ends to be slid on the tonebar 30 during string installation. This initial bend reduces or limits the strings from sliding off the end at bend 46B during installation of the tonebar.

The tonebar 30 is made of brass, which is generally available and known as fourteen (14) gauge craft wire. While brass is used in one embodiment, other materials for the tonebar 30 are contemplated. Brass is an alloy made of copper and zinc. Brass also has a ductility that enables the ends to be bent relatively easily when installed as described and illustrated in FIG. 13. The use of brass and other electrically conducting metals provides for connection to a grounding wire 49, if the guitar electrically amplified, including being amplified by an acoustic guitar pickup or by being amplified by an electric guitar amplifier or public address (PA) system.

Figure 5:
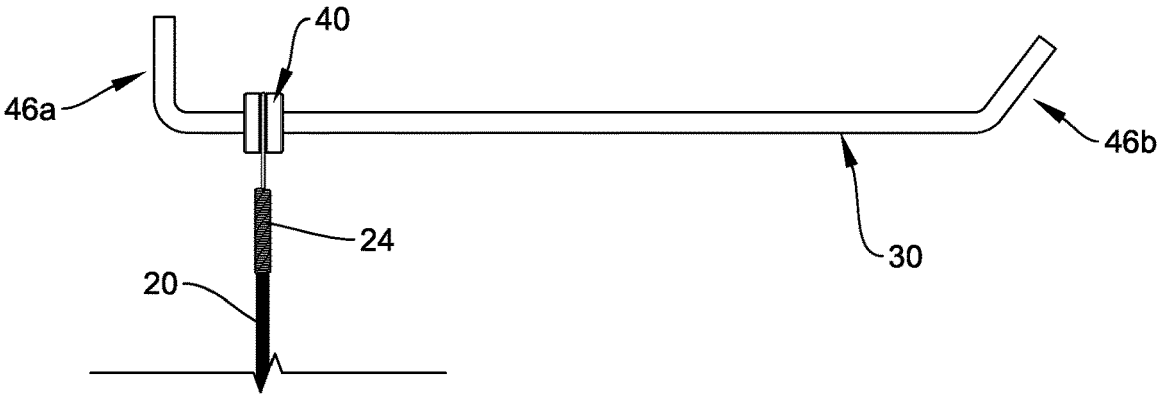
Figure 6:
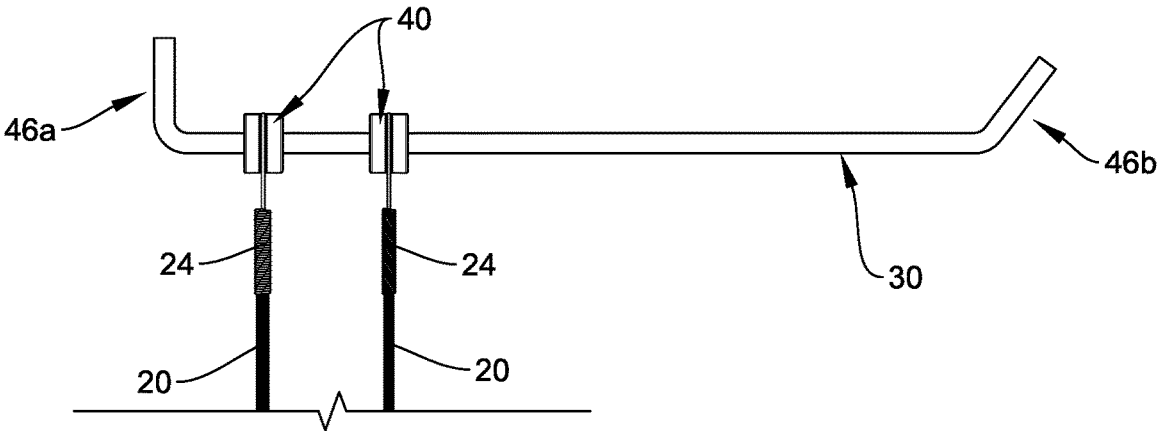
Figure 7:
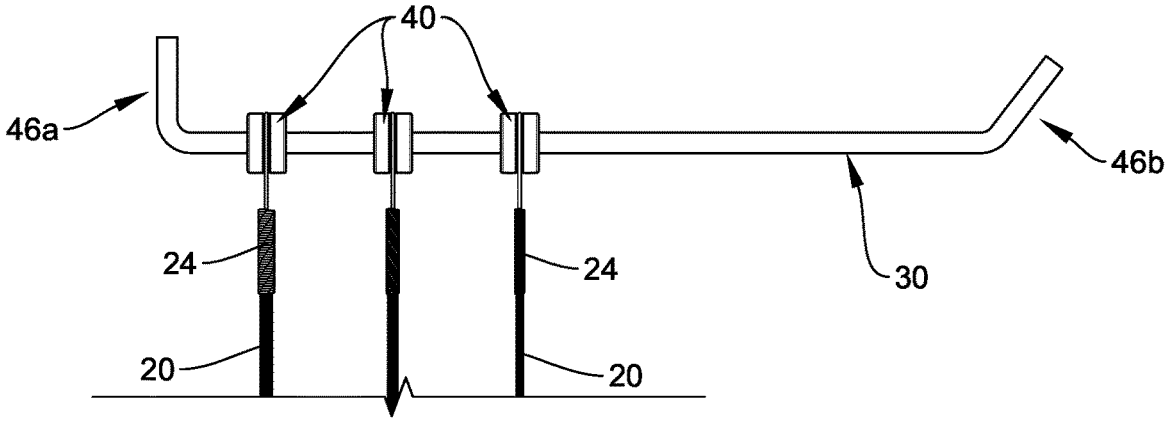
Figure 8:
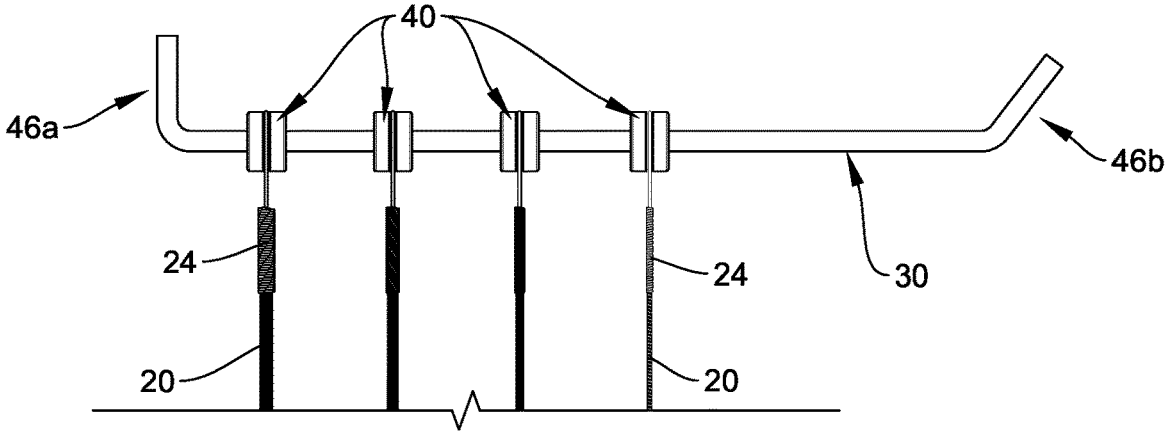
Figure 9:
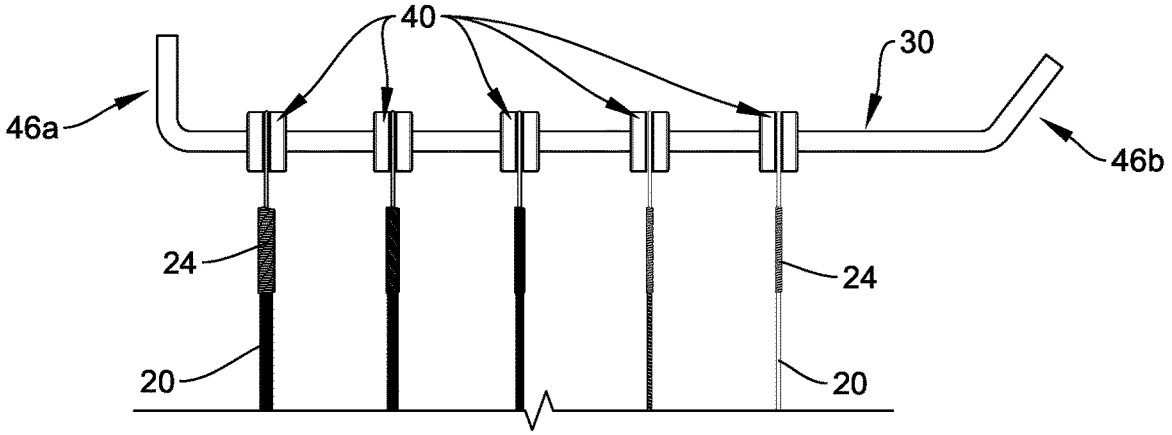

The tonebar 30 initially is completely straight from end to end and includes straight ends which are modified to include bent ends 46A and 46B. As seen in FIG. 5, a first step of a process to install the tonebar 30 includes the use of a tonebar having one or both ends that are bent before the ball ends of each string are placed on the tonebar bar 31. To begin stringing the guitar, each of the ball ends of each string are inserted into the appropriate string holes 22 from the top of the guitar and into the body prior to attaching the non-ball ends of the strings to the tuning pegs. Since the strings at this point are not attached to the tuning pegs, each string is inserted sufficiently into one of the string holes 22, then into the body of the guitar, and then back to or through the sound hole 26. By inserting the ball ends back through the sound hole 26, the ball ends are accessible to the user for inserting the ball ends of the strings onto the tonebar. In another embodiment, the ball ends are generally located at the should hole 26, still inside the bode of the guitar but accessible to the user for assembly of the tonebar to the strings. In one embodiment, the ball ends 40 of the strings are extended sufficiently from the string holes 22 within the guitar body but accessible at the exterior of the guitar for connection to the tonebar 30. In another embodiment, the ball ends 40 of the strings remain in the body for insertion of the tonebar 30, if desired.

In one embodiment, the straight bar is pre-bent at the end 46A to an angle of substantially 90 degrees. This end 46A is pre-bent to prevent the ball ends from sliding off the end 46A of the tonebar 30 during installation. In another embodiment, the end 46A is not bent but includes a cross-section that is larger than the diameter D of the ball end. The end 46B also includes a bend of less than 90 degrees, in which the angle of the bend is not too great to prevent placing the ball ends of the string onto the tonebar.

Each of the ball ends 40 of each string are placed onto the tonebar 30 in sequence, such that the A string is moved onto the tonebar 30 immediately after the low E string. As further illustrated in FIGS. 5-10, each subsequent ball end of each of the remaining strings is moved onto the tonebar 30, in order, such that the strings are arranged from low E to high E. Of course, in other guitars having different numbers of strings, the strings are sequentially arranged as necessary. For instance, a tenor guitar includes 4 strings while a bass guitar can include 5 strings. Seven string guitars are also known.

Once all of the ball ends of each string have been placed on the tonebar 30 as illustrated in FIG. 11, the end 46B is bent by the user to substantially 90 degrees. In other embodiments, the end 46B is bent to other degrees as desired or necessary to prevent the strings from moving off the tonebar 30.

Once the end 46B has been bent, the portions of the strings that extend into the holes on the topside of the bridge are pulled away from the bridge by the user. As the strings are pulled, the tonebar 30 moves into contact with the bridge plate 32 and each of the ball ends moves into a correct position aligned with the holes. As the strings are pulled, ball ends that are not correctly aligned slide along the tonebar if needed, to align with the respective hole. At this point, the free end of the strings are attached to the tuning pegs for tuning. At some point before the guitar is tuned to the desired pitch or key, the tonebar 30 is rotated about its longitudinal axis to move the ends 46A and 46B to be flush with the surface of the bridge plate 32.

FIGS. 12A, 12B, and 12C illustrate other embodiments of the tonebar. As seen in FIG. 12A a tone bar 50 includes a length sufficient to engage a single string 52. FIG. 12B illustrates a tonebar 54 having a length sufficient to engage two strings 56. FIG. 12C illustrates a tonebar 57 sufficient to engage three strings 58. Other embodiments of tone bars include different lengths that are sufficient to engage other numbers of strings, including for instance 4, 5, 7 or more strings.

Different length tone bars are used for different stringed instruments having different numbers of strings. For instance, a tonebar having a length sufficient to support 4 strings is used for a tenor guitar. In one embodiment, the tonebar supporting two strings, for instance, is used in a six string guitar to support the high E string and B string only, with the remaining strings low E, A, D, and G being coupled to the bridge using bridge pins. In this embodiment, the user prefers the sound of the low E, A, D, and G strings using bridge pins, but prefers enhancing the sound of the high E string and B string using the two string tonebar.

Figure 13:
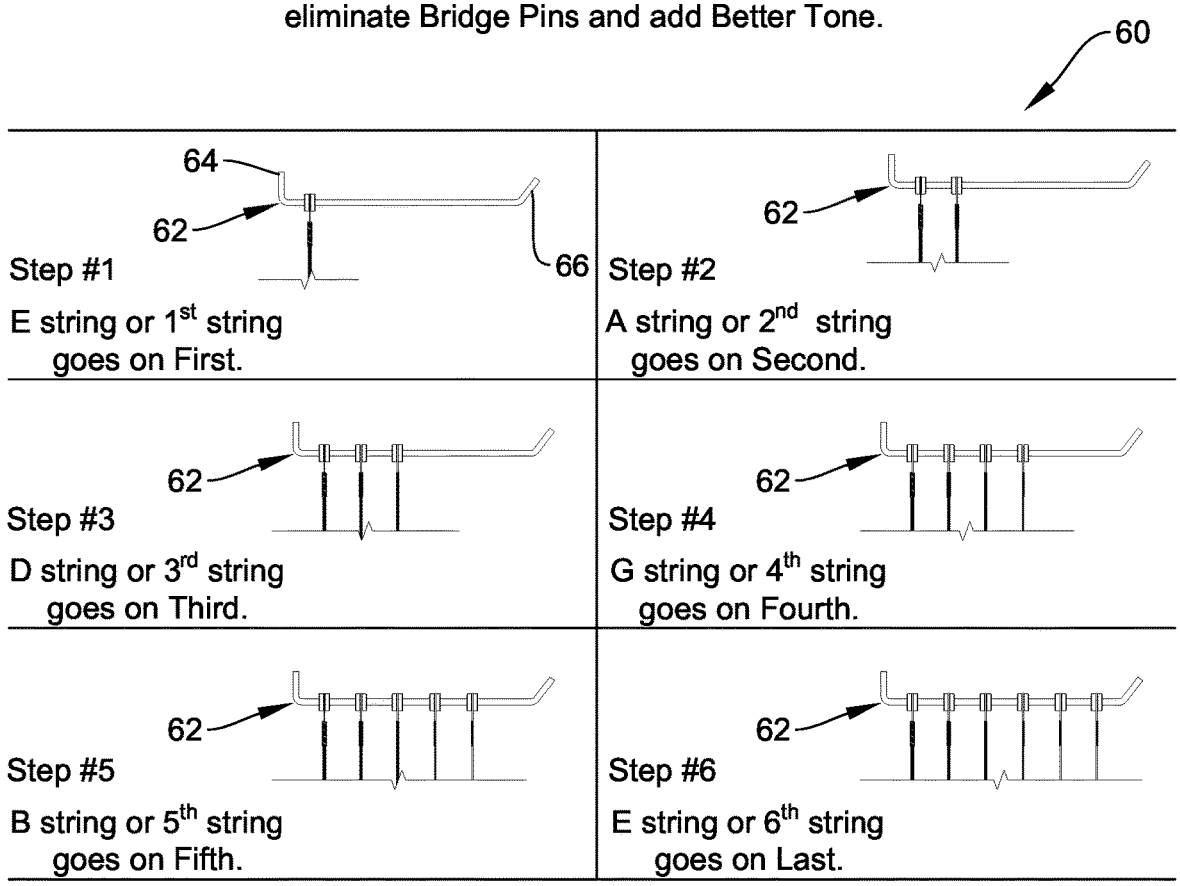
FIG. 13 illustrates a set of instructions provided on an instruction sheet that is provided with a tonebar.
Figure 13:
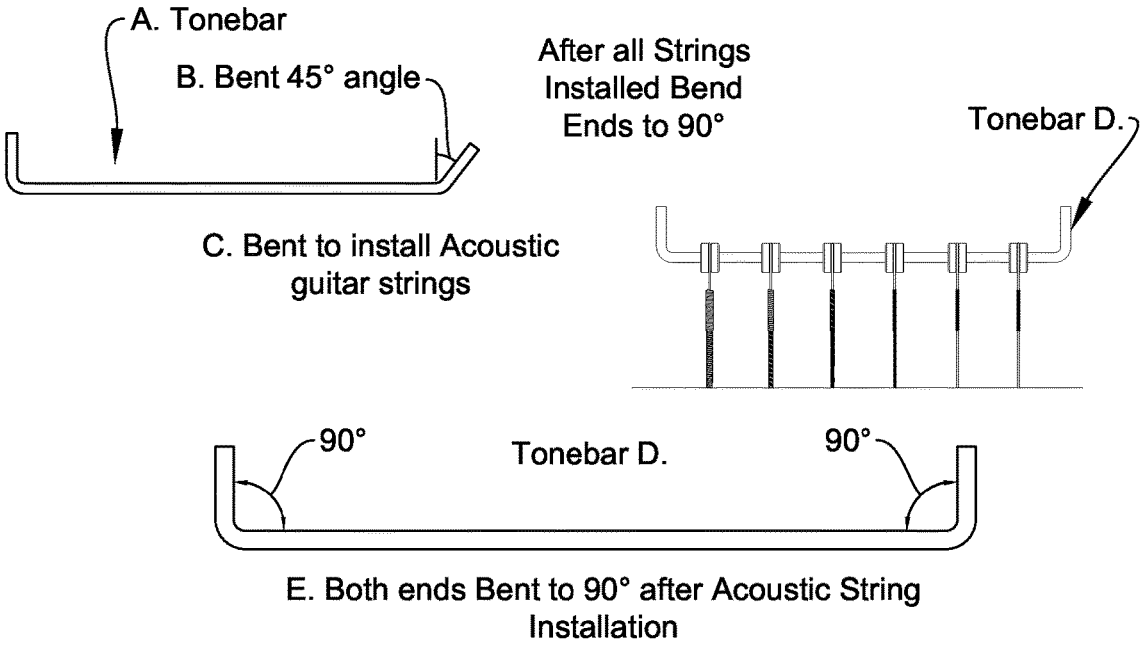

FIG. 13 illustrates a set of instructions provided on an instruction sheet 60 that is included with a tonebar 62. The instruction sheet 60 is sold in a package with the tonebar 62 as a kit including one or more tone bars and the instruction sheet 60. For instance, in one embodiment, two tone bars are sold as a kit with the instruction sheet, where each tonebar is made of a different material. In other embodiments, the kit includes a single tonebar of one material type. Different types of single tonebar kits are provided with tone bars of different materials. For instance, one kit includes a brass tone bar, and another kit includes a tonebar made of other types of single materials or made of other alloy materials. In other embodiments, kits include the instruction sheet 60 and two or more tone bars of the same material for users having multiple guitars.

The instruction sheet instructs the user to move the ball ends of each string sequentially onto the tonebar, low E first, followed in order by strings A, D, G, B, and high E. In another embodiment, the instruction sheet instructs the user to move the ball ends of each string sequentially onto the tonebar, high E first, followed in order, strings B, G, D, A, and low E. The instruction sheet provides an instruction to the user to for each string being installed in sequence. Other instruction sheets are contemplated illustrating the steps of installation.

As seen in Step 1, the tonebar 62 is provided to a user with a first end 64 being prebent to a 90 degree angle and a second end 66 begin prebent at an angle of less than 90 degrees. The angle 66 includes an angle that enables the ball ends to be moved onto the tonebar 62 without being obstructed by the bend having too great an angle. By providing a prebent second end 66, the second end is more easily bent to a preferred angle such as 90 degrees once each ball end of each string has been located on the tonebar 62. In one embodiment, the bend is made by a pliers such as a slip joint pliers or a needle nose pliers.

As described herein, the acoustic guitar string mount and method does not require bridge pins and the holes in which bridge pin are inserted remain free of bridge pins with just the string extending through the holes. Using this system, the user can achieve better muting control at the bridge with the user's palm or arm. Since the bridge pins are not in the way and do not obstruct the user's palm or arm, more accurate control of muting is achieved. The lack of bridge pins can also give the guitar a cleaner look. While the bridge pins are not required, some users may prefer the look of bridge pins. In this case, the ends of the bridge pins are cut off and the cutoff bridge pins, with the head remaining, are inserted as before and do not interfere with the function of the tonebar. In other embodiment, precut bridge pins are includes with the kit.

Since the tonebar contacts and engages the bottom of the bridge plate, the acoustic tone of the guitar is enhanced, since the sound of a moving string is transmitted from the string, to the bridge, through the soundboard, to the bridge plate, and to the tonebar. Contact of the tonebar achieves a better tone, as the strings and tonebar transmit substantially more sound to the soundboard. This increased transmission of sound affects the vibration of the soundboard and improves the sound of any guitar that traditionally requires bridge pins. The tonebar sonicity couples the strings to the soundboard providing an improved sound when compared to guitars using bridge pins. In fact, the tonebar has been found to improve the sound of guitars having laminated soundboards, such as plywood, which are often considered to have inferior sound when compared to guitars having solid tops. Sound is also improved for guitars having soundboards made of a solid wood, including fine premier woods of higher end guitars when using the tonebar.

In one embodiment, since the tonebar includes bent ends, the bent ends of the tonebar, are laid flat against the bridge plate after installation of all of the strings. In this position, the bent ends provide an increased contact area which better transmits the sound though the soundboard. These bent ends also provide an electrical grounding location for acoustic guitars having electrical pickups as described in FIG. 3. Since each string is coupled to the tonebar through metal to metal contact, the tonebar provides an enhanced ground that grounds all of the strings, which reduces or eliminates ground noise.

With the tonebar in place and the guitar in tune, the acoustic guitar mount using the tonebar, greatly reduces the stress applied to the glued down bridge by pulling the bridge down to the soundboard instead of pulling the bridge off of the guitar soundboard. Consequently, the tonebar does not damage the bridge plate, the soundboard, or the bridge, when compared to damage caused to these parts using bridge pins inserted through the bridge. When bridge pins are used, the ball ends displaced from alignment with the holes due to insertion of the bridge pins are positioned underneath the bridge plate. The ball ends, and therefore the strings, pull up on the bridge plate, the soundboard, and the bridge. In a large number of acoustic guitars the bridge is glued to the soundboard and the bridge plate is glued to the soundboard. Each of these glue joints is subjected to stress which over a period of time can delaminate the bridge from the soundboard and/or the soundboard from the bridge plate.

Figure 14:
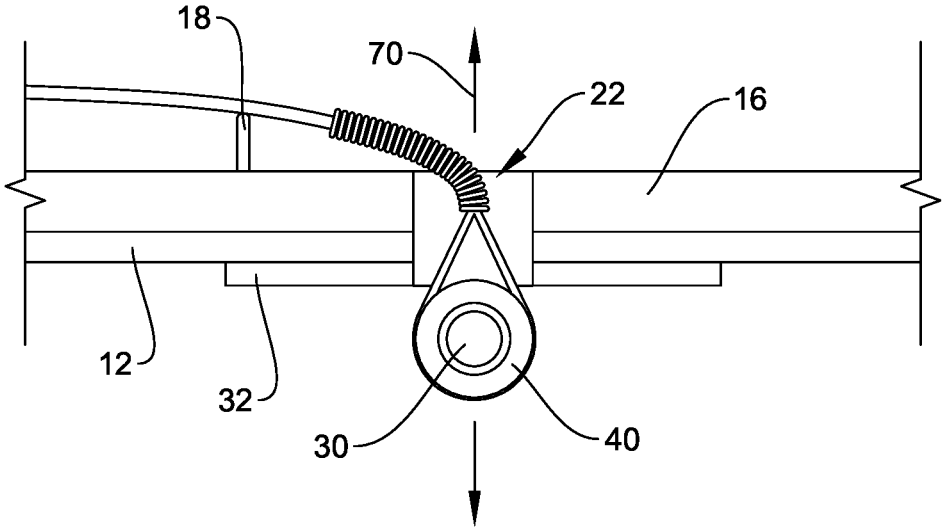
FIG. 14 illustrates a sectional sideview of a hole extending through a bridge, a soundboard, and a bridge plate, with a string extending through the hole and coupled to a tonebar.

As described herein and as seen in FIG. 14, however, the ball ends are not moved to a location underneath the bridge plate 32, but remain substantially in line with a longitudinal axis 70 of the hole 22. The condition in which the ball end pulls up on the bridge plate is substantially eliminated by eliminating the use of bridge pins. As seen in FIG. 14, the tonebar 30, when under string tension, is pulled against ball end 40. Due to the difference in the outer diameter of the tonebar 30 and the inner diameter of D of the ball end 40, a small gap 72 between the tonebar 30 and a bottom portion of the ball end 40 may appear. Since ball ends of guitar strings are standardized in size, the gap between the ball end and tonebar is small and contact is increased. Gap 72 is exaggerated in FIG. 14 to better illustrate the gap. Consequently, the sound transmission from the tonebar to the soundboard benefits from making the diameter of the tonebar close to the inner diameter of the ball end, for instance a difference of substantially 5 thousandths of an inch.

Figure 15A:
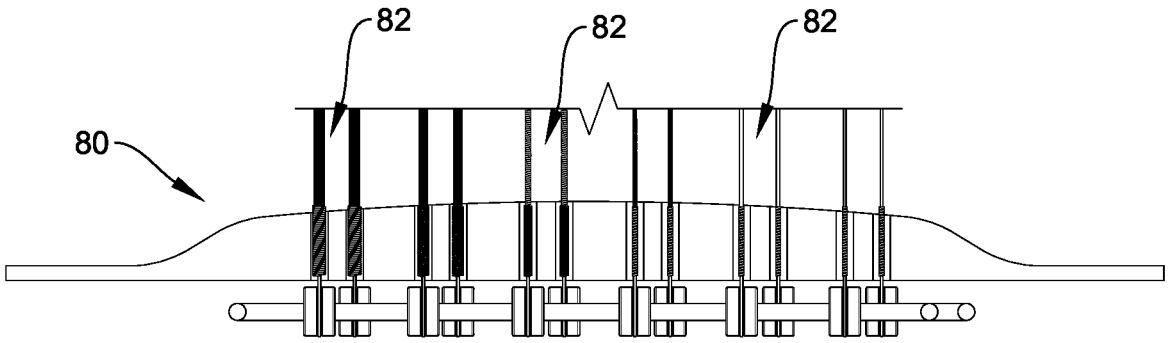
FIGS. 15A and 15B illustrates a side view and partial plan view of an underside of a 12 string guitar soundboard having two tonebars.
Figure 15B:
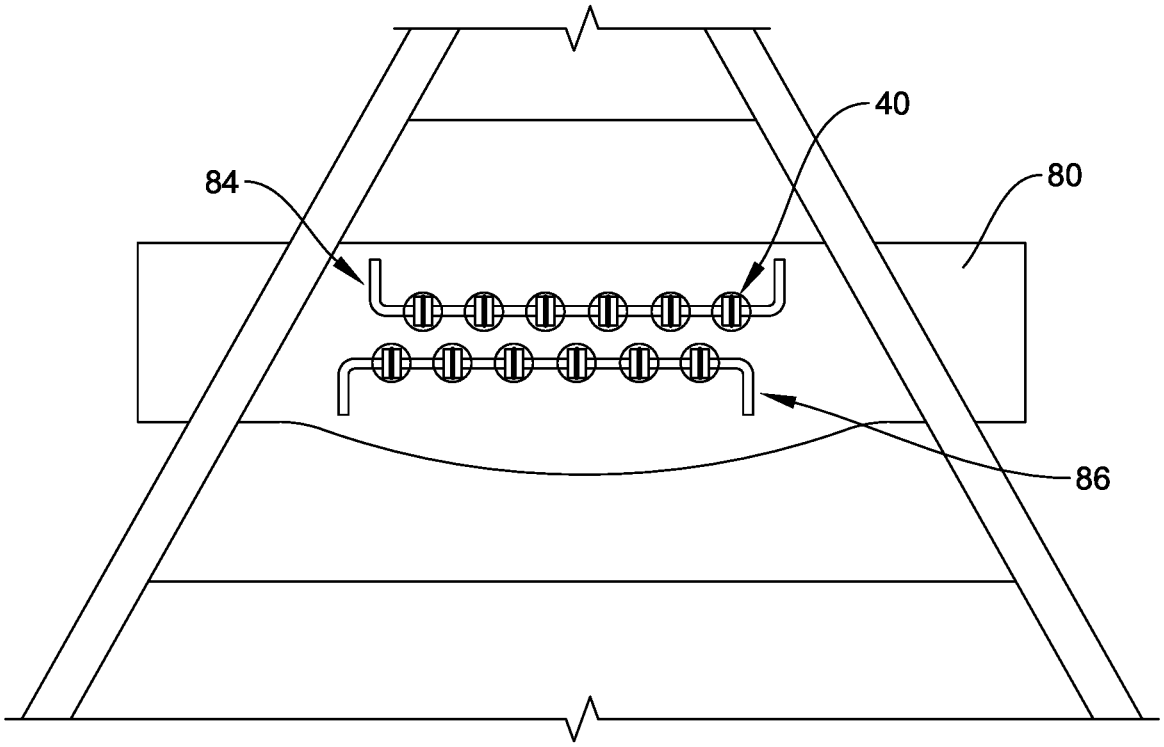

FIG. 15A illustrates a side view of an underside of a 12 string guitar soundboard and bridge plate having two tonebars. The bridge plate is not shown. As known by those skilled in the art, a bridge 80 includes 12 holes each of which receives one of twelve strings 82. Six of the strings are coupled to a first tonebar 84 and six of the strings are coupled to a second tonebar 86. Once the ball ends of the six of the strings are attached to one of the tonebars 84 or 86, the remaining six strings are attached to the other of the tonebars 84 and 86. Either one of the tonebars 84 or 86 may receive that ball ends of six strings as described herein. Once each of the tonebars 84 and 84 is coupled to ball ends of the strings, the strings are tuned to pitch and each of the tonebars is pulled into contact with the bridge 80. See FIG. 15B.

Figure 16:
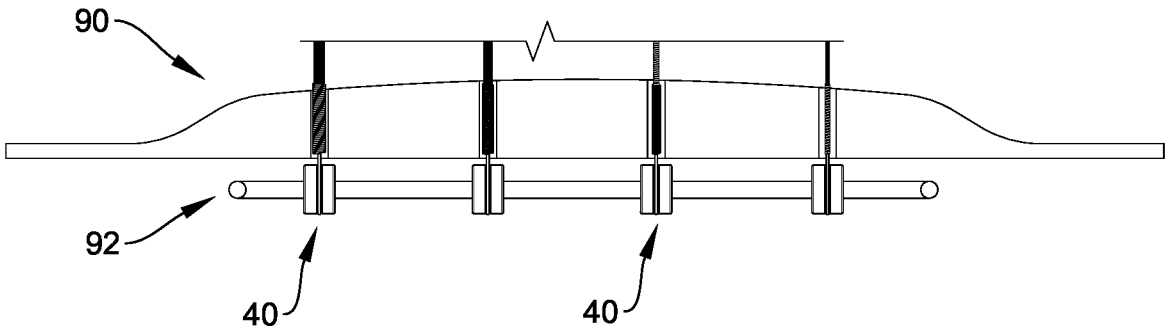
FIG. 16 illustrates a sideview of a tonebar attached to strings of a bass guitar.
Figure 17:
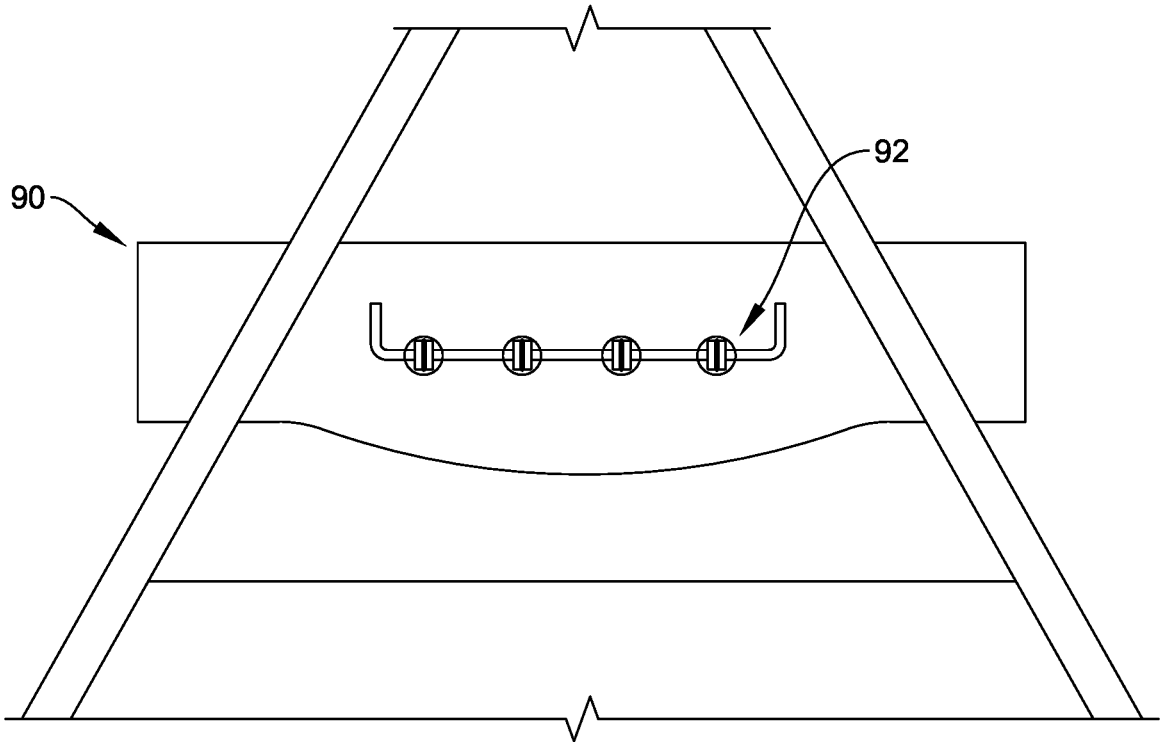
FIG. 17 illustrates a plan view of a tonebar of attached to a bass guitar.

FIG. 16 illustrates a sideview of a tonebar 92 attached to an acoustic bass guitar having four strings. Other numbers of strings are contemplated for a bass guitar. While not shown in FIG. 16, a bridge plate is located between a bridge 90 and the ball ends of the strings. The ball ends of the strings are attached to the tonebar 92 as described herein. As further seen in FIG. 17, a bass guitar bridge plate includes holes to receive ball ends of the bass strings. Once the tone bar 92 receives the stings, the tone bar 92 is pulled to the bridge plate during tuning to pitch.

Figure 18A:
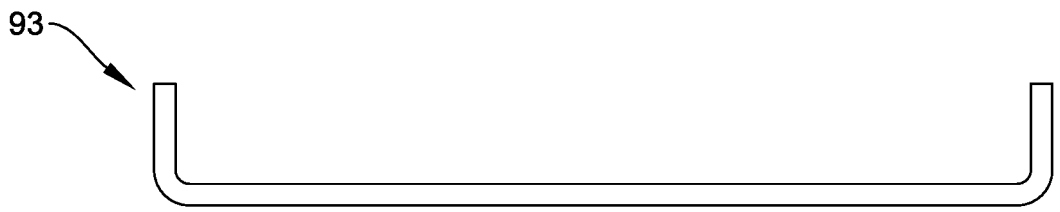
FIGS. 18A and 18B illustrate a tonebar for a bass guitar and a ball end of a bass string to which the tonebar is attached.
Figure 18B:
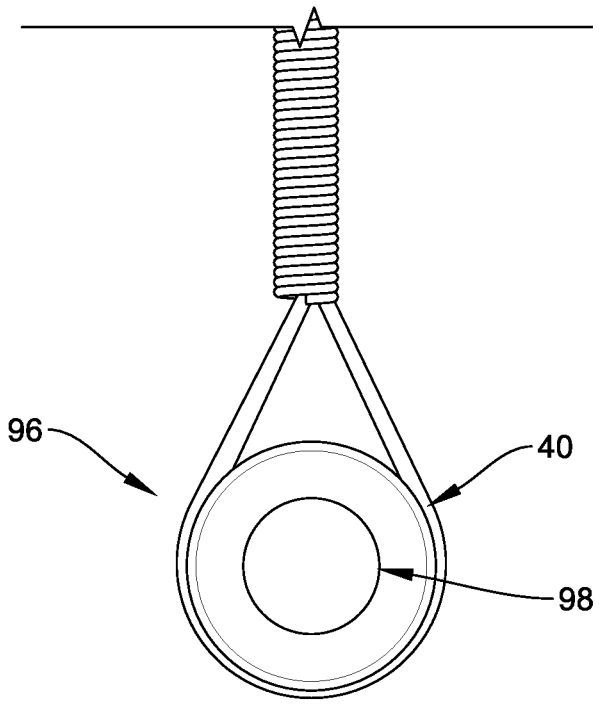

FIGS. 18A and 18B illustrate a tonebar 93 for the bass guitar. Since the gauge of strings for a bass guitar generally larger than those of a 6 string guitar or a 12 string guitar, the ball ends are larger. For instance, a ball end 96 include an inner diameter 98 of generally 0.125 inch and an outside diameter of 0.238 inch. In this embodiment, the tonebar 92 is approximately 4.5 inches long and is a 9 gauge brass wire having a diameter of approximately 0.1144 inches. The tonebar 92, therefore, includes a diameter sufficient for insertion into each of the ball ends 96.

Figure 19:
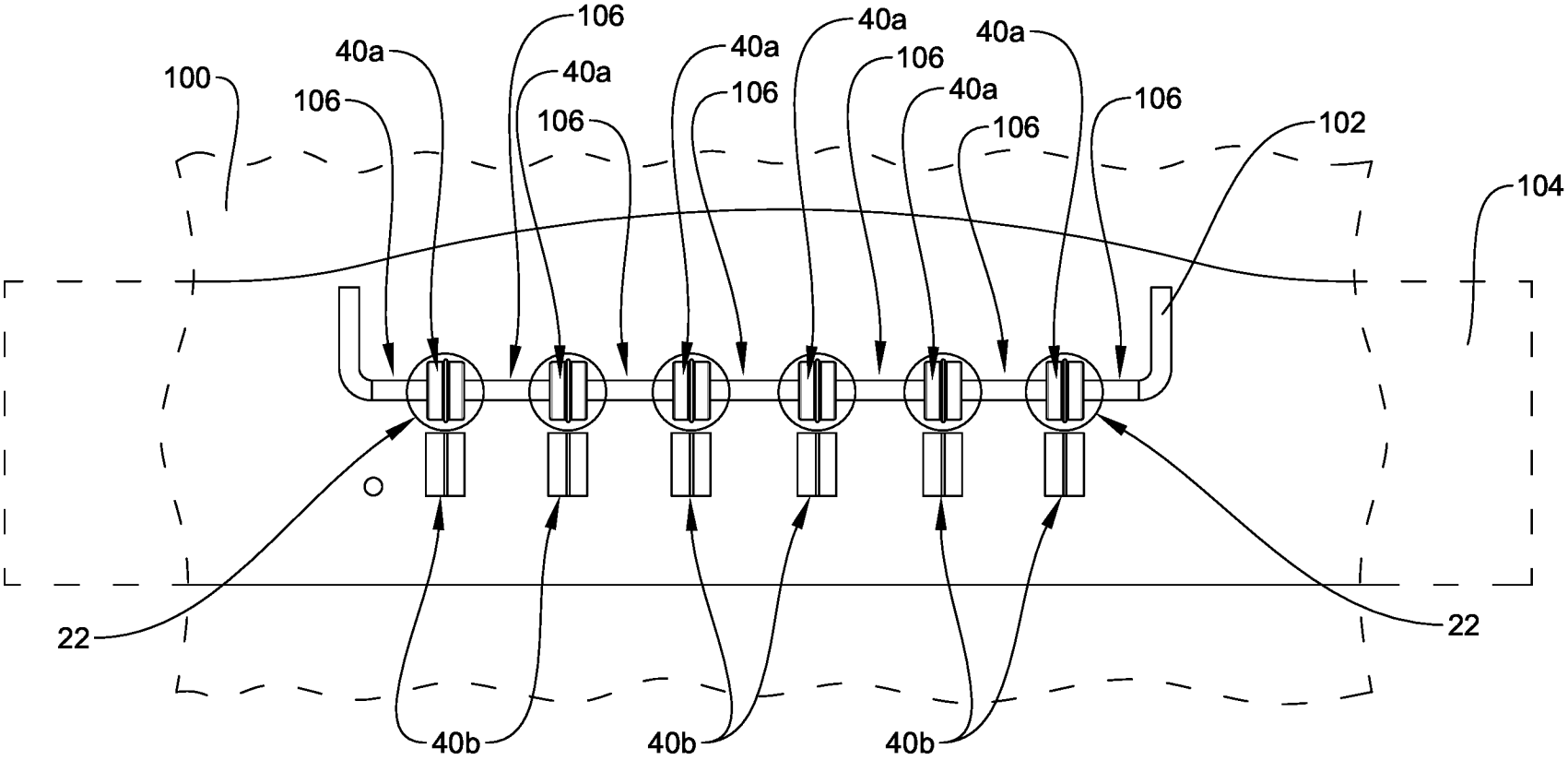
FIG. 19 illustrates a diagrammatic view comparing ball end of strings in contact with a bridge plate and a tone bar in contact with the bridge plate.

FIG. 19 illustrates a diagrammatic view comparing ball ends of strings coupled to a tone bar 102 in contact with a bridge plate 100 and ball ends of strings offset from holes 22 when bridge pins are used. In this comparative diagrammatic view, ball ends 40B of the strings are in contact with a portion of the bridge plate 100 and a tone bar 102 is in contact with the bridge plate 100. This illustration represents contacting locations of the ball ends 40B of strings on the bridge plate 100 without the use of a tone bar compared to contacting locations 106 of the tone bar 102 on the bridge plate 100 with the use of the tone bar. This figure also shows a bridge 104 in schematic outline to illustrate the location of the bridge 104 on the opposite side of the soundboard with respect to the bridge plate 100. As seen, the ball ends 40B are offset from the holes 22 as a result of being displaced by bridge pins.

As seen in FIG. 19, the locations of the ball ends 40B contact discrete portions of the bridge plate 100 at only those discrete locations where the ball ends 40 are displaced from the holes and are pulled into contact under string tension at the bridge plate 100. Bridge plate areas between the ball ends 40 are not in contact with the ball ends and sound transfer from the strings to the bridge plate 104 is interrupted. When the tone bar 102 is used, however, the contacting locations 106 of the tone bar 102 are pulled into contact with the bridge plate 102. Transmission of sound from the strings to the bridge plate 102, to the guitar soundboard, and to the bridge 104 is enhanced. The contacting locations 106 are pulled into the bridge plate and provide for an increased sound transmission between a plucked string and the soundboard.

While the method for installing strings is generally applicable to installing a new complete set of strings sequentially on the tonebar, the method is not limited to installing a new complete set of strings, but single or multiple strings are also intended for installation by removing some strings adjacent to the string(s) to be removed, and then attaching the new string or strings to the tonebar and reinstalling the remaining removed strings.

The present disclosure, therefore, provides a string mounting system and method of mounting the strings which improves the transmission of sound between the strings and the soundboard, which enhances the sound quality, and which increases the life of the guitar. As described herein, the tonebar provides improved sound transfer in any type of stringed instrument having strings that terminate in ball ends. Consequently, the sound delivered by the instruments soundboard is improved, even for stringed instruments having laminated tops.

While exemplary embodiments incorporating the principles of the present disclosure have been disclosed hereinabove, the present disclosure is not limited to the disclosed embodiments. Instead, this application is intended to cover any variations, uses, or adaptations of the disclosure using its general principles. Further, this application is intended to cover such departures from the present disclosure as come within known or customary practice in the art to which this disclosure pertains and which fall within the limits of the appended claims.

The invention claimed is:

1. An acoustic guitar string mounting system for installing acoustic guitar strings having ball end on a guitar having string holes extending through a bridge, a soundboard, and a bridge plate, the mounting system comprising:

a tonebar including a rod, the rod including a length extending from a first terminating end to a second terminating end, wherein the tonebar includes a substantially constant diameter extending along the length of the rod and wherein the constant diameter is less than an inner diameter of a hole in each of the ball ends of the guitar strings, and the rod is located in the hole in each of the ball ends.

2. The acoustic guitar string mounting system of claim 1 wherein the guitar is a six string guitar having six string holes with a first string hole spaced from a sixth string hole a predetermined distance apart, and the length of the rod is greater than predetermined distance.

3. The acoustic guitar string mounting system of claim 2 wherein the inner diameter of the holes of each of the ball ends is substantially 0.082 inches.

4. The acoustic guitar string mounting system of claim 3 wherein the constant diameter of the rod is substantially 0.078 inches.

5. The acoustic guitar string mounting system of claim 3 wherein the constant diameter of the rod is substantially 0.005 inches less than the inner diameter of holes of the ball ends.

6. The acoustic guitar of claim 2 wherein one or both of the first terminating end and the second terminating end are bent with respect to a longitudinal axis of the rod.

7. The acoustic guitar string mounting system of claim 6 wherein the first terminating end is bent to an angle of substantially 90 degrees with respect to a longitudinal axis of the rod.

8. The acoustic guitar string mounting system of claim 6 wherein the second terminating end is bent to an angle of substantially 45 degrees.

9. The acoustic guitar string mounting system of claim 8 wherein the rod is located in each of the ball ends of each of the six strings, and the strings are arranged sequentially from a first string to a sixth string along the rod.

10. A method of installing a set of acoustic guitar strings on an acoustic guitar having string holes extending through a bridge, a soundboard with a sound hole, and a bridge plate, wherein each string of the set includes a ball end, the method comprising:

providing a tonebar including a rod, the rod including a length extending from a first terminating end to a second terminating end, wherein the tonebar includes a constant diameter extending along the length of the rod and the constant diameter is less than an inner diameter of each of the ball ends of the guitar strings;

inserting the ball end of one of the strings through one of the string holes;

inserting the ball end of each of the remaining strings through one of the string holes not previously receiving an inserted ball end;

pulling each string though the respective string hole and through the sound hole a sufficient distance such that each of the ball ends is accessible;

inserting the first end of the rod into the ball end of a first one of the set of strings;

inserting the first end of the rod into the ball end of each of the remaining strings;

pulling each of the strings though the string holes from the top of the soundboard to engage the tonebar with the bridge plate; and tuning the guitar to a predetermined pitch.

11. The method of claim 10 wherein each of the inserting and pulling steps are provided to a user with a set of instructions.

12. The method of claim 10 wherein the guitar is a six string guitar having six string holes with a first string hole spaced from a sixth string hole spaced a predetermined distance apart, and the length of the rod is greater than predetermined distance.

13. The method of claim 12 wherein the inner diameter of the ball ends is substantially 0.082 inches.

14. The method of claim 13 wherein the constant diameter of the rod is substantially 0.078 inches.

15. The method of claim 13 wherein the constant diameter of the rod is substantially 0.005 inches less than the inner diameter of the ball ends.

16. The method of claim 15 wherein one or both of the first terminating end and the second terminating end are bent with respect to a longitudinal axis of the rod.

17. The method of claim 15 further comprising bending the first terminating end to an angle of substantially 90 degrees.

18. The method of claim 17 further comprising bending the second terminating end to an angle of substantially 45 degrees.

19. The method of claim 16 wherein the rod is located in each of the ball ends of each of the six strings, and the strings are arranged sequentially from a first string to a sixth string along the rod.

20. The method of claim 10 wherein the set of acoustic guitar strings includes a set of standard tuning guitar strings having strings of low E, A, D, G, B, and E, and the inserting the first end of the rod into the ball end includes inserting the first end of the rod into one of the low E string or the high E string, and the inserting the first end of the rod into the ball end of each of the remaining strings includes inserting the first end of into ball ends of each string sequentially to connect each string to an appropriate tuning pegs of the guitar.

* * * * *